United States Patent [19]

Jacob

[11] Patent Number: 4,607,749

[45] Date of Patent: Aug. 26, 1986

[54] EASY OPEN ENVELOPE

[75] Inventor: Lewis E. Jacob, Topeka, Kans.

[73] Assignee: American Envelope Co., Chicago, Ill.

[21] Appl. No.: 718,113

[22] Filed: Apr. 1, 1985

[51] Int. Cl.[4] ..... B65D 27/16; B65D 27/34

[52] U.S. Cl. ..... 206/610; 206/632; 229/80; 229/81

[58] Field of Search ..... 206/610, 632; 229/80, 229/81

[56] References Cited

U.S. PATENT DOCUMENTS

| | | | |
|---|---|---|---|
| 1,234,867 | 7/1917 | Bushnell, Jr. | 229/81 |
| 1,306,224 | 6/1919 | Godley . | |
| 1,336,646 | 4/1920 | Mendenhall . | |
| 2,189,273 | 2/1940 | Shomaker | 206/632 |
| 2,944,728 | 7/1960 | Whitman | 229/80 |
| 3,460,743 | 8/1969 | Burnett . | |
| 3,489,332 | 1/1970 | Knittel . | |
| 3,652,008 | 3/1972 | Grotefend . | |
| 3,853,262 | 12/1974 | Tucker et al. | 229/80 |
| 4,093,074 | 6/1978 | Bielawski | 206/629 |
| 4,190,161 | 2/1980 | Gendron | 229/72 |
| 4,470,511 | 9/1984 | Meeker et al. | 206/610 |

*Primary Examiner*—Stephen P. Garbe

*Attorney, Agent, or Firm*—McDougall, Hersch & Scott

[57] ABSTRACT

The envelope is especially designed to bulky contents such as bank statements with cancelled checks and the like. The back panel of the envelope is provided with a rupturable cut score line which is parallel to the bottom edge of the envelope and which is overlain by the closure flap of the envelope when the latter is closed. An initiating tab projects below the lower edge of the closure flap. The lower edge of the closure flap is parallel to the bottom edge of the envelope, and the closure flap is secured to the back panel of the envelope by a latex adhesive which is adherent without being moistened. Adhesive spots are provided on the inner surface of the envelope to releasably secure the contents in place in the envelope.

5 Claims, 4 Drawing Figures

EASY OPEN ENVELOPE

The invention relates to an easy open envelope of the type having a rupturable cut score line by which the envelope can be quickly and neatly torn open to gain access to its contents. The envelope of this invention is particularly adapted to hold bulky contents.

Easy tear open envelopes of the type which are provided with rupturable cut score patterns to gain access to the contents of the envelope are known in the prior art. Examples of such envelopes are disclosed in U.S. Pat. Nos. 1,306,224, issued June 10, 1919 to F. A. Godley; 1,336,646, issued Apr. 13, 1920 to J. J. Mendenhall; 3,460,743, issued Aug. 12, 1969 to R. C. Burnett; 3,652,008, issued Mar. 28, 1972 to W. H. Grotefend; 4,093,074, issued June 6, 1978 to W. E. Bielawski; and 4,470,511 issued Sept. 11, 1984 to David M. Meeker et al. Similarly, easy open envelopes having releasable adhesive on the closure flaps are known in the prior art as seen in U.S. Pat. Nos. 3,489,332, issued Jan. 13, 1970 to W. Knittel; and 3,853,262 issued Dec. 10, 1974 to C. L. Tucker et al.

As will be noted from the above referenced patent disclosures, the rupturable cut score patterns will generally be formed in the back panel of the envelope and may or may not be overlain by the closure flap of the envelope when the envelope is sealed. The score patterns usually assume a V-shaped pattern and the individual cuts may take a number of forms.

The envelope of this invention is an improved easy open envelope which is particularly adapted for containing bulky materials such as bank statements and accompanying cancelled checks, or the like. Such mail is packaged in the envelopes, closed, weighed, segregated according to weight and then postage is applied by passing the filled, closed envelopes through postage metering machines. The postage may be applied by means of a stamp roll or by means of moistened postage tapes applied to the envelopes. In either case, the envelopes are run through a machine serially and passed through a nip which forms the stamping or tape applicating station on the machine. This operation, due to the bulkiness of the filled, sealed envelopes, subjects them to the possibility of rupture. For this reason, bulk mail envelopes of this type, if made of the easy open variety, utilize an easy open adhesive flap rather than a rupturable cut score line. The adhesive would be of the resealable latex variety so as not to loosen were the envelope exposed to a moist environment such as formed in a tape applying postage metering machine. The reason that the rupturable cut score line easy open feature has not been used in such bulk mailing envelopes is because of the liklihood of premature rupture of the score line as the envelope passes through the postage nip.

The envelope of this invention utilizes a rupturable cut score line array which is formed on the back panel of the envelope and which is parallel to the bottom edge of the envelope. A grip tab is formed medially of the cut score line array by a curved cut, the tab projecting toward the bottom edge of the envelope. The closure flap of the envelope overlies the cut score array when in the closed or sealing position and the closure flap has a lower edge which is parallel to the bottom edge of the envelope. The grip tab projects beyond the lower edge of the closure flap when the latter seals the envelope closed. Latex pressure adhesive is used to secure the closure flap to the outer surface of the back panel.

There is a first layer of the latex adhesive on the inner surface of the closure flap and that adhesive layer has a lower edge which is upwardly offset from the uppermost edge of the cut score array when the closure flap is in its closed condition. There is a second layer of the latex adhesive on the outer surface of the back panel between the cut score array and the top edge of the back panel. The bottom edge of the second layer of adhesive is substantially coextensive with the top edge of the cut score array. With the adhesive layers as described, the cut score array is adequately protected by the closure flap when the envelope is passed through a postage metering machine whereby the cut score array will not rupture while in the metering machine. At the same time, the adhesive will not cause the closure flap to interfere with proper operation of the cut score array when the envelope is opened. In addition to the above, the envelope is also provided with latex adhesive spots on its inner surfaces, one on the front wall and one on the closure flap which releasably secure the contents of the envelope against shifting with the envelope. The open envelope may be used as a storage receptacle for the contents. When so used, the adhesive spot on the closure flap holds the latter closed by adhering to the contents to better protect the contents from falling out of the envelope.

It is, therefore, an object of this invention to provide an improved easy open envelope of the type having an array of rupturable cut score lines whereby a wall of the envelope may be torn in a controlled manner.

It is a further object of this invention to provide an envelope of the character described which is adapted to contain bulky material and which will not rupture when passed through a postage metering machine.

It is an additional object of this invention to provide an envelope of the character described wherein the cut score array is overlain by the closure flap when the envelope is closed.

It is also an object of this invention to provide an envelope of the character described which includes tacky latex adhesive coatings to hold the closure flap in place and latex adhesive spots on the interior of the envelope to hold the contents in place in the envelope.

These and other objects and advantages of the invention will become more readily apparent from the following detailed description of a preferred embodiment thereof when taken in conjunction with the accompanying drawings, in which.

Figure 1:
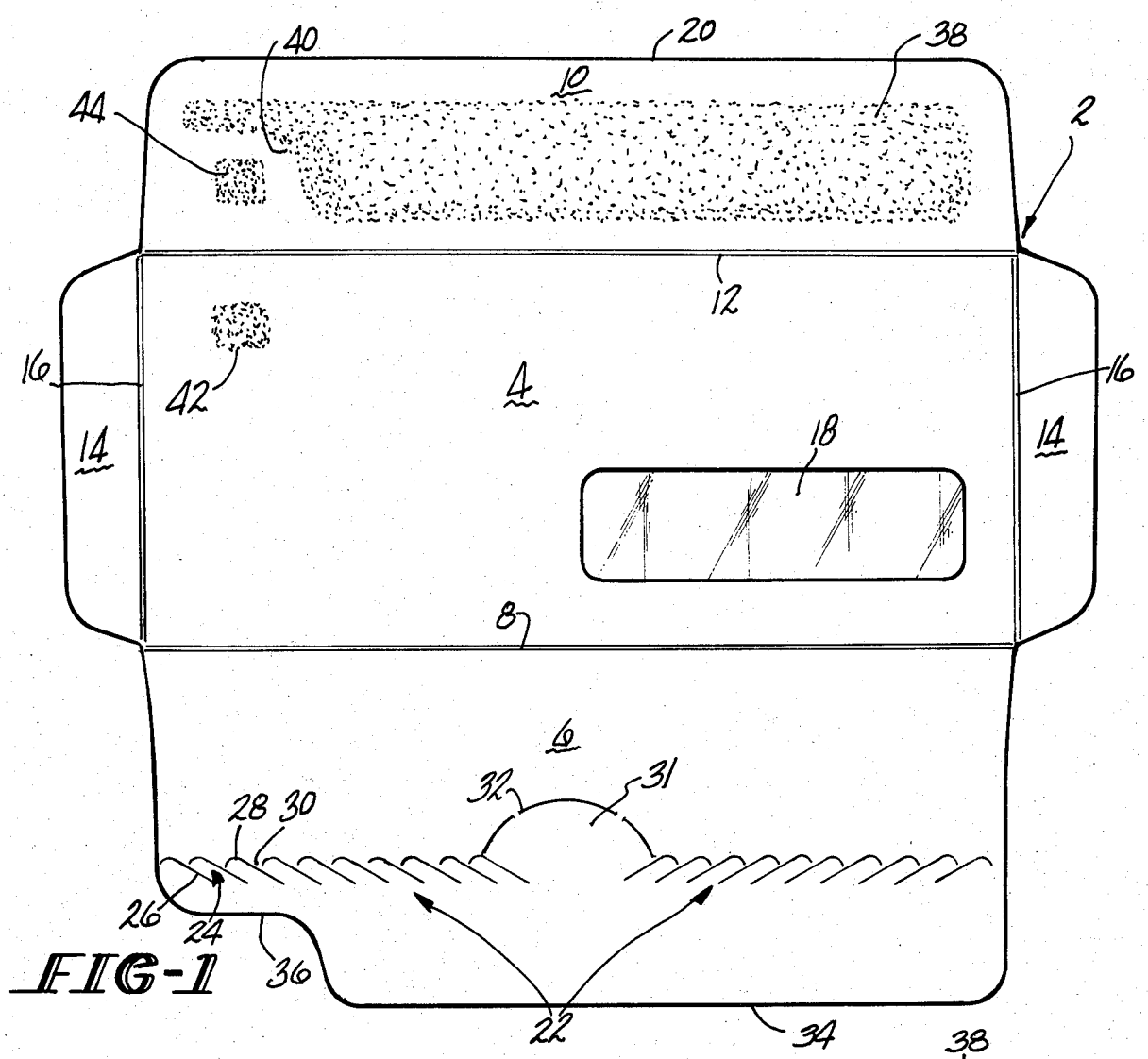
FIG. 1 is a plan view of a cut and scored paper blank from which the envelope of this invention is formed.

Referring now to the drawings, there is shown in FIG. 1 a cut scored blank denoted generally by the numeral 2 which is used to form the envelope of this invention. The blank 2 includes a front wall 4 and a back wall 6 connected to the front wall 4 along a bottom fold line 8. A closure flap 10 is connected to the front wall 4 along a top fold line 12. Side flaps 14 are connected to the front wall 4 along side fold lines 16. An address window 18 may be provided in the front wall 4. The free edge 20 of the closure flap 10 is parallel to the bottom fold line 8. There is formed on the back wall an array of cut score lines, denoted generally by the numeral 22. Each of the cut scores 24 includes a rectilinear portion 26 which merges into a curvilinear portion 28. Each curvilinear portion 28 has a terminal which is separated from the rectilinear portion of the adjacent cut score by a web of paper 30 which is preferably about one sixteenth of an inch across. The curvilinear portions 28 are preferably about a one quarter inch radius. Medially of the cut score array 22, there is formed a gripping tab 31 defined by a curvilinear cut 32. The curvilinear portions 28 of the cut scores 24 are all tangent to an imaginary line which is substantially parallel to the bottom fold line 8, the top fold line 12, and the free edge 20 of the closure flap 10. The free edge 34 of the back wall 6 is contoured at 36 so as to form an undercut. A latex adhesive layer 38 is deposited on the inside surface of the closure flap 10 and is contoured at 40 to match the contour 36 on the free edge 34 of the back panel 6. A latex adhesive spot 42 is disposed on the inside surface of the front wall 4 and a similar adhesive spot 44 is disposed on the inside surface of the closure flap 10. The adhesive spots are aligned with each other and with the contour 36 on the free edge 34 of the back wall 6.

Figure 2:
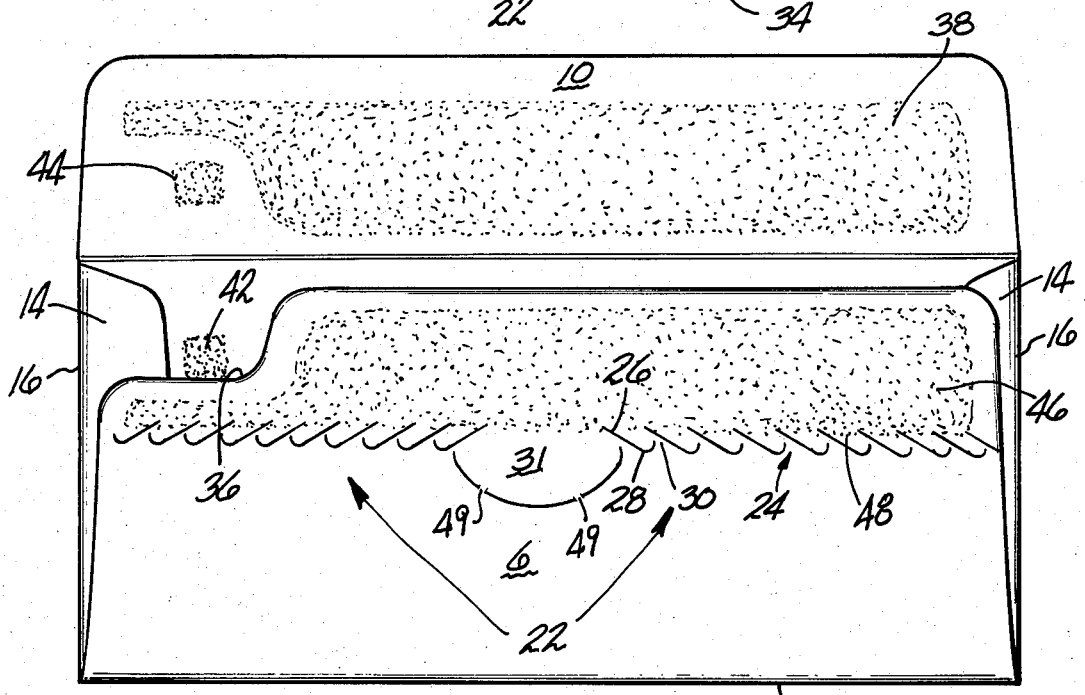
FIG. 2 is a plan view similar to FIG. 1 but showing the back wall of the envelope folded up and secured in place.
Figure 3:
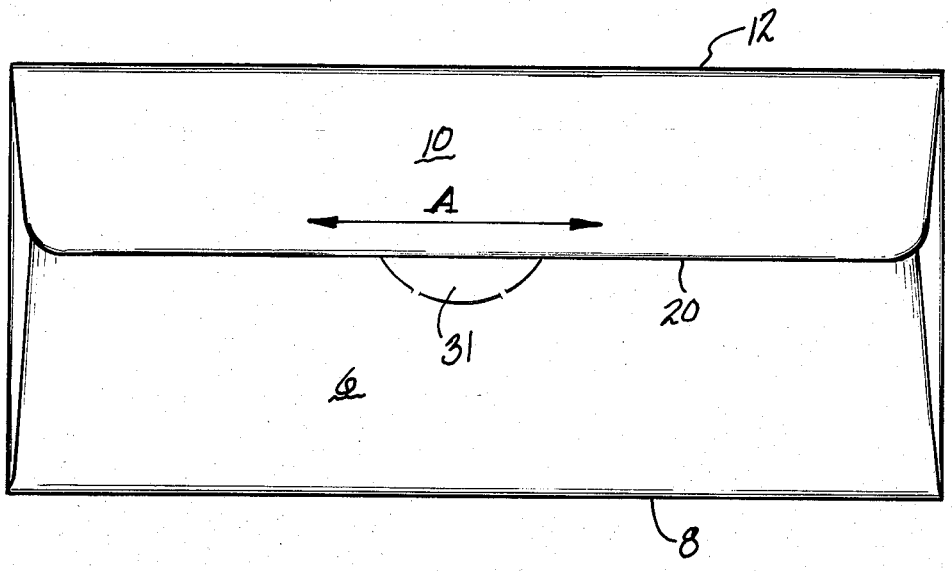
FIG. 3 is a plan view of the back of the envelope showing the latter in a closed condition.

Referring now to FIGS. 2 and 3, the open envelope shown in FIG. 2 is formed by folding the side flaps 14 in along fold lines 16 and then folding the back wall 6 up about fold line 8 wherein the back wall 6 is adhesively secured to the side flaps 14. With the back wall 6 in this position, the contour 36 leaves the adhesive spot 42 visible, and the contour 36 also provides access for the adhesive spot 44 to contact the contents of the envelope when the closure flap 10 is folded down to close the envelope. A coating 46 of latex adhesive is deposited on the outer surface of the back panel 6. The lower edge 48 of the adhesive coating 46 is spaced apart from the bottom fold line 8 of the envelope so that the adhesive 46 overlies the upper end portions of the rectilinear portions 26 of the cut scores 24 but terminates short of the curvilinear portions 28 of the cut scores. The interposed paper webs 30 are thus free of adhesive. After being stuffed with contents, the envelope is closed by folding the closure flap 10 about fold line 12 into overlapping relationship with the back wall 6. The adhesive spots 42 and 44 releasably adhere to the contents of the envelope sufficiently to hold the contents in the proper position in the envelope. The adhesive layers 38 and 46 contact each other to cause the closure flap 10 to remain in the closed position. The free edge 20 of the closure flap 10 is close enough to the bottom fold line 8 to ensure that the closure flap 10 completely covers the cut score array 22. At the same time, the gripping tab 31 projects downwardly past the free edge 20 of the closure flap 10. In this manner, the upper part of the back wall 6 is adhered to the closure flap 10. This adherence extends down to the uppermost fringe of the cut score arrays 22 but stops short of the connecting webs 30.

It will be noted from FIG. 2 that if the envelope is filled with bulky material, this will not expose the cut score arrays to opening and possible damage from external forces because the closure flap 10 covers and protects the cut score arrays. Uncut portions 49 are provided along the cut line 32 to prevent the tab 31 from projecting out when the envelope is filled with bulky material. The filled envelopes, when fed through a postage metering machine, will move in the direction of the arrows A. It will be noted that the direction of the cut score arrays 22 and of the free edge 20 of the closure flap coincides with the arrows A so that the edge 20 and the cut score arrays 22 will not tend to be snagged by the metering machine components.

Figure 4:
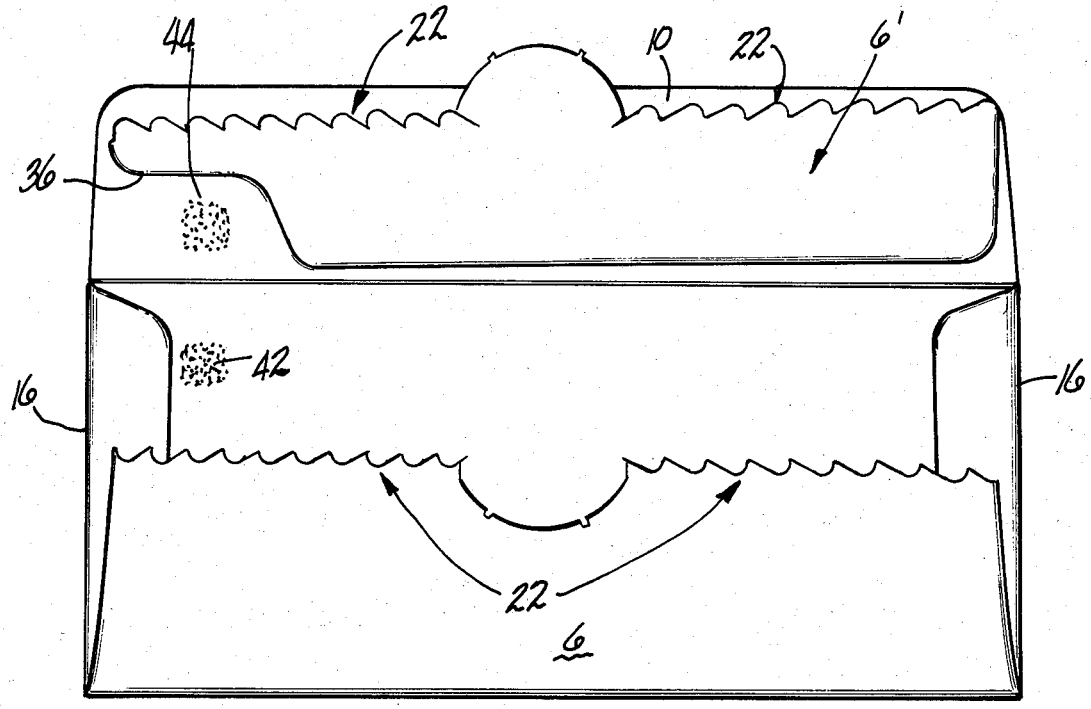
FIG. 4 is a plan view similar to FIG. 3 but showing the envelope after it has been opened by rupturing the cut score array.

To open the envelope, one grasps the gripping of tab 31 and the adjacent closure flap material and pulls the two out and up toward the fold line 12. As seen in FIG. 4, the paper webs 30 between the cut scores 24 rupture and the upper portion 6' of the back wall 6 remains secured to the closure flap 10. The contour 36 exposes the adhesive spot 44 on the inner surface of the closure flap 10 when the flap 10 is opened. The lower portion of the back wall 6 is substantially the same height from fold line 16 to fold line 16. This provides a secure storage capability to the envelope after the contents are removed, reviewed, and returned to the envelope. The adhesive spot 42 will releasably adhere the contents to the interior of the envelope once returned, and the adhesive spot 44 will releasably adhere the closure flap 10 to the contents and in a closed position once the refilled envelope is reclosed. An improved storage capability is thus imparted to the envelope.

It will be readily appreciated that the envelope of this invention will be easily opened by means of the cut score arrays and, yet, will not prematurely open due to protection of the cut score arrays by the closure flap. The envelope also displays improved retention of its contents against shifting and also provides an improved storage capability for material which is to be saved.

Since many changes and variations of the disclosed embodiment of the invention may be made without departing from the inventive concept, it is not intended to limit the invention otherwise than as required by the appended claims.

What is claimed is:

1. An easy open envelope comprising:

(a) a front wall;

(b) a back wall connected to said front wall along a bottom fold line;

(c) side panels connected to said front wall along side fold lines, said side panels being adhesively secured to said back wall;

(d) a closure flap connected to said front wall along a top fold line, said closure flap having a bottom free edge which is substantially parallel to said bottom fold line;

(e) an array of cut scores formed in said back wall, said array extending in a line which is substantially parallel to said bottom fold line, said cut scores being separated from each other by rupturable webs;

(f) adhesive means operable to secure said closure flap to said back wall in a closed position, said adhesive means having a lower edge which is spaced upwardly from said webs; and (g) said closure flap overlying said array of cut scores completely when said closure flap is in said closed position.

2. The envelope of claim 1 further comprising a first adhesive spot on an inside surface of said front wall for releasably securing contents of said envelope in place, and a cut-out contour on a top edge of said back wall, said cut-out contour being aligned with said first adhesive spot.

3. The envelope of claim 2 further comprising a second adhesive spot on an inside surface of said closure flap for releasable engagement with contents of the envelope, said second adhesive spot being aligned with said cut-out contour when said closure flap is in said closed position.

4. The envelope of claim 1 further comprising a grip tab cut in said back wall medially of said cut score array, said grip tab projecting past said bottom free edge of said closure flap when the latter is in said closed position.

5. An easy open envelope comprising:

(a) a front wall;

(b) a back wall connected to said front wall along a bottom fold line;

(c) side panels connected to said front wall along side fold lines, said side panels being adhesively secured to said back wall;

(d) a closure flap connected to said front wall along a top fold line, said closure flap having a bottom free edge which is substantially parallel to said bottom fold line;

(e) said back wall having a top free edge which is substantially parallel to said bottom fold line, and said top free edge of said back wall having a cut-out contour therein;

(f) a first adhesive spot on an inside surface of said front wall, said first adhesive spot being aligned with said cut-out contour and being operable to releasably secure contents of the envelope in place therein, the first adhesive spot positioned below the top free edge of the back wall and within the cut-out contour; and (g) a second adhesive spot on an inside surface of said closure flap, said second adhesive spot being aligned with said cut-out contour when said closure flap is in a closed position overlying said back wall, said second adhesive spot being operable to releasably secure said closure flap to contents of the envelope to hold said closure flap in said closed position.

* * * * *